US006699168B2

(12) United States Patent
Hayward et al.

(10) Patent No.: US 6,699,168 B2
(45) Date of Patent: Mar. 2, 2004

(54) ROTARY CENTRIFUGE HAVING PIVOTING BUCKETS FOR HOLDING SAMPLES

(75) Inventors: David Hayward, San Jose, CA (US); Hanzel Lawas, Fremont, CA (US)

(73) Assignee: Beckman Coulter, Inc., Fullerton, CA (US)

( * ) Notice: Subject to any disclaimer, the term of this patent is extended or adjusted under 35 U.S.C. 154(b) by 201 days.

(21) Appl. No.: 10/037,312

(22) Filed: Dec. 20, 2001

(65) Prior Publication Data

US 2003/0119645 A1 Jun. 26, 2003

(51) Int. Cl.[7] ..... B04B 5/02
(52) U.S. Cl. ..... 494/20; 215/357
(58) Field of Search ..... 494/16, 20, 21, 494/33, 85; 74/572; 422/72, 102; 215/270, 332, 356, 357

(56) References Cited

U.S. PATENT DOCUMENTS

| | | | | |
|---|---|---|---|---|
| 788,495 | A | * | 4/1905 | Sawin |
| 1,538,848 | A | * | 5/1925 | Dunnock |
| 2,733,052 | A | * | 1/1956 | Luther |
| 3,266,718 | A | * | 8/1966 | Stahl et al. |
| 3,377,021 | A | * | 4/1968 | Fox et al. |
| 3,687,359 | A | * | 8/1972 | Scanlon |
| 4,344,563 | A | | 8/1982 | Romanauskas |
| 4,391,597 | A | | 7/1983 | Piramoon |
| 4,400,166 | A | * | 8/1983 | Chulay et al. |
| 4,548,596 | A | | 10/1985 | Sutton et al. |
| 4,670,004 | A | | 6/1987 | Sharples et al. |
| 5,496,255 | A | * | 3/1996 | Chang |
| 5,518,130 | A | | 5/1996 | Weyant, Jr. |
| 5,591,114 | A | | 1/1997 | Romanauskas |
| 5,681,258 | A | | 10/1997 | Lowe et al. |
| 5,855,289 | A | | 1/1999 | Moore |
| 6,060,022 | A | | 5/2000 | Pang et al. |
| 6,062,407 | A | | 5/2000 | Moore |
| 6,193,642 | B1 | | 2/2001 | Hristake |

FOREIGN PATENT DOCUMENTS

| | | | |
|---|---|---|---|
| DE | 2900121 | * | 7/1980 |
| JP | 2000-24550 | * | 1/2000 |

* cited by examiner

*Primary Examiner*—Charles E. Cooley
(74) *Attorney, Agent, or Firm*—William H. May; D. David Hill; Janah & Associates

(57) ABSTRACT

A bucket is capable of holding a sample container in a rotary centrifuge. The bucket has a receptacle to receive the sample container and a trunnion joined to the bucket. The trunnion has a plurality of cutouts that each define a flexible span that is sufficiently thin to flex under application of a centrifugal force generated by the rotary centrifuge, and pivot pins to that allows the bucket to pivot under the application of the centrifugal force. The receptacle has an open end having an internal surface with a tapering groove and a self-seating cap having pegs sized to fit in the tapering groove.

33 Claims, 10 Drawing Sheets

ROTARY CENTRIFUGE HAVING PIVOTING BUCKETS FOR HOLDING SAMPLES

BACKGROUND

Embodiments of the present invention relate to a rotary centrifuge for centrifuging samples.

A rotary centrifuge rotates sample containers containing samples to apply centrifugal forces to the samples. The sample may be, for example, a fluid to which centrifugal forces are applied to separate, for example, components of the fluid that have different densities. Typically, the rotary centrifuge has a rotatable hub to receive pivoting buckets and a drive mechanism to rotate the hub. The pivoting buckets each comprise a receptacle to receive a sample container and a closing cap. A trunnion attached to the bucket has pivot pins that seat in corresponding holes in the hub of the centrifuge to allow the bucket to pivot as the hub is rotated. Trunnion springs may also be used to allow the buckets in their pivoted position to be displaced radially outwardly at high rotational velocities until the buckets are supported by a circumferential surface of the hub to reduce the centrifugal load on the bucket itself while still allowing the centrifugal forces to still operate on the sample in the bucket.

However, such conventional trunnion and bucket systems have several problems. One problem is that the interfaces and joints of conventional trunnion and bucket systems are often not as strong as desirable. For example, the joint between the trunnion and pivot pins can weaken at high rotational speeds. In addition, the trunnion spring mechanism that allows the bucket to slide radially outwardly at high speeds is also difficult to manufacture with sufficient strength and resilience. Also, when multiple components are assembled to make a trunnion and bucket system, such systems are more susceptible to failure from mis-assembly or misalignment of the different components. Another problem arises when the cap is not properly attached to the receptacle of the bucket. During operation of the centrifuge, vibrations may cause the cap to rotate and loosen off the receptacle, causing the sample held inside to be damaged.

Thus, it is desirable to have a bucket, trunnion, and trunnion spring, that is strong, resilient and provides improved ease of assembly and manufacture. It is also desirable to have a receptacle cap that remains securely attached to the receptacle during operation of the centrifuge. It is further desirable for the cap to be easily attached to and removed from the receptacle.

SUMMARY

A bucket is capable of holding a sample container in a rotary centrifuge. The bucket comprises (a) a receptacle to receive the sample container; and (b) a trunnion joined to the receptacle, the trunnion comprising: (i) a plurality of cutouts that each define a flexible span; and (ii) pivot pins to allow the bucket to pivot under the application of a centrifugal force generated by the rotary centrifuge.

A bucket capable of holding a sample container in a rotary centrifuge, the rotary centrifuge comprising an external seat, and the bucket comprising:

(a) a receptacle to receive the sample container, the receptacle comprising a seating surface; and (b) a trunnion joined to the receptacle, the trunnion comprising:

(i) a plurality of cutouts that each define a flexible span that is sufficiently flexible to flex under application of a centrifugal force generated by the rotary centrifuge to allow the seating surface of the receptacle to seat against the external seat of the rotary centrifuge whereby the centrifugal force applied on the pivot pins may be reduced; and (ii) pivot pins to allow the bucket to pivot under the application of the centrifugal force.

A bucket capable of holding a sample container in a rotary centrifuge, the bucket comprising:

(a) a receptacle to receive the sample container, the receptacle comprising an open end having an internal surface with a groove, the groove having an opening, an end, and a width that decreases in size from the opening to the end;

(b) a cap capable of closing the open end of the receptacle, the cap comprising pegs that are sized to fit in the groove; and (c) a trunnion comprising a pair of pivot pins to allow the bucket to pivot under the application of a centrifugal force generated by the rotary centrifuge.

A bucket capable of holding a sample container in a rotary centrifuge, the bucket comprising:

(a) a receptacle to receive the sample container, the receptacle comprising an open end having an internal surface with a groove therein, the groove having an opening, an end, and a width that decreases from the opening to the end;

(b) a cap capable of closing the open end of the receptacle, the cap comprising pegs that are sized to fit in the groove; and (c) a trunnion comprising:

(i) a plurality of cutouts that each define a flexible span that is sufficiently thin to flex under application of a centrifugal force generated by the rotary centrifuge; and (ii) a pair of pivot pins to allow the bucket to pivot under the application of the centrifugal force.

DRAWINGS

These features, aspects, and advantages of the present invention will become better understood with regard to the following description, appended claims, and accompanying drawings which illustrate examples of the invention. However, it is to be understood that each of the features can be used in the invention in general, not merely in the context of the particular drawings, and the invention includes any combination of these features, where:

Figure 7A:
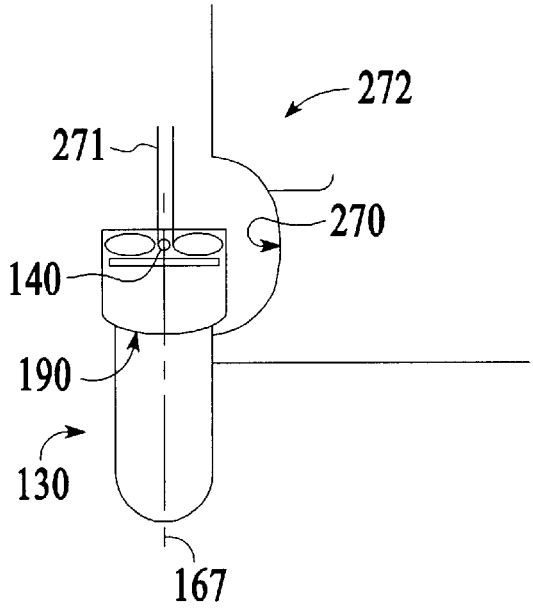
Figure 7B:
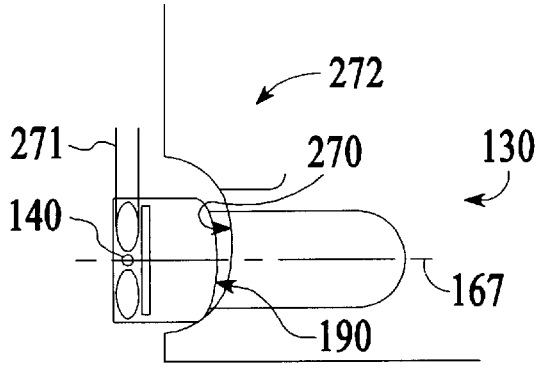
Figure 7C:
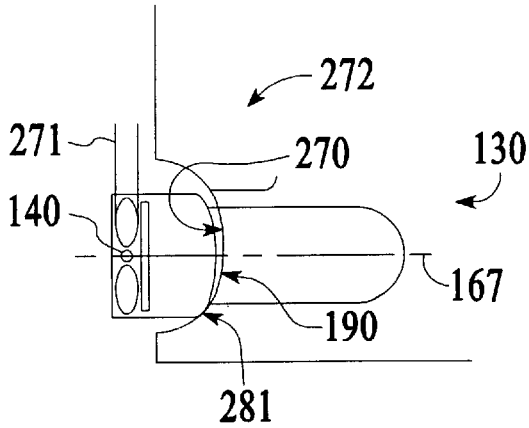
Figure 7D:
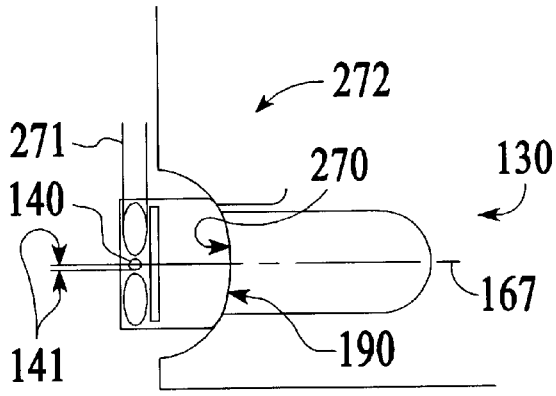
Figure 7E:
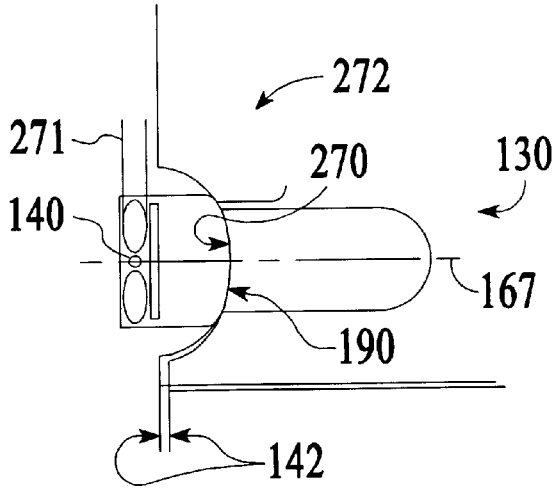
Figure 7F:
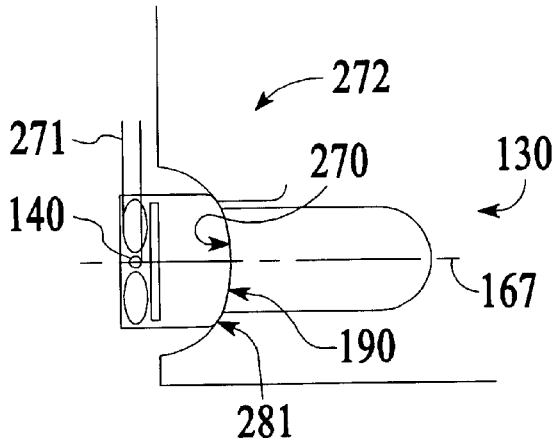

FIG. 7*a* is a cross-sectional side view of a bucket and an external seat in a stationary state of the rotary centrifuge;

FIG. 7*b* is a cross-sectional side view of the bucket of FIG. 7*a* as it begins to seat on the seating surface as the rotary centrifuge accelerates;

FIG. 7*c* is a cross-sectional side view of the bucket of FIG. 7*b* continuing to seat on the external seat as the rotary centrifuge continues to accelerate;

FIG. 7*d* is a cross-sectional side view of the bucket of FIG. 7*c* completely seated on the external seat;

FIG. 7*e* is a cross-sectional side view of the bucket and seating surface of FIG. 7*d* after the seating surface is partially deformed by the centrifugal force generated in the rotary centrifuge;

FIG. 7*f* is a cross-sectional side view of the bucket being displaced in the partially deformed seating surface of FIG. 7*e;*

Figure 2:
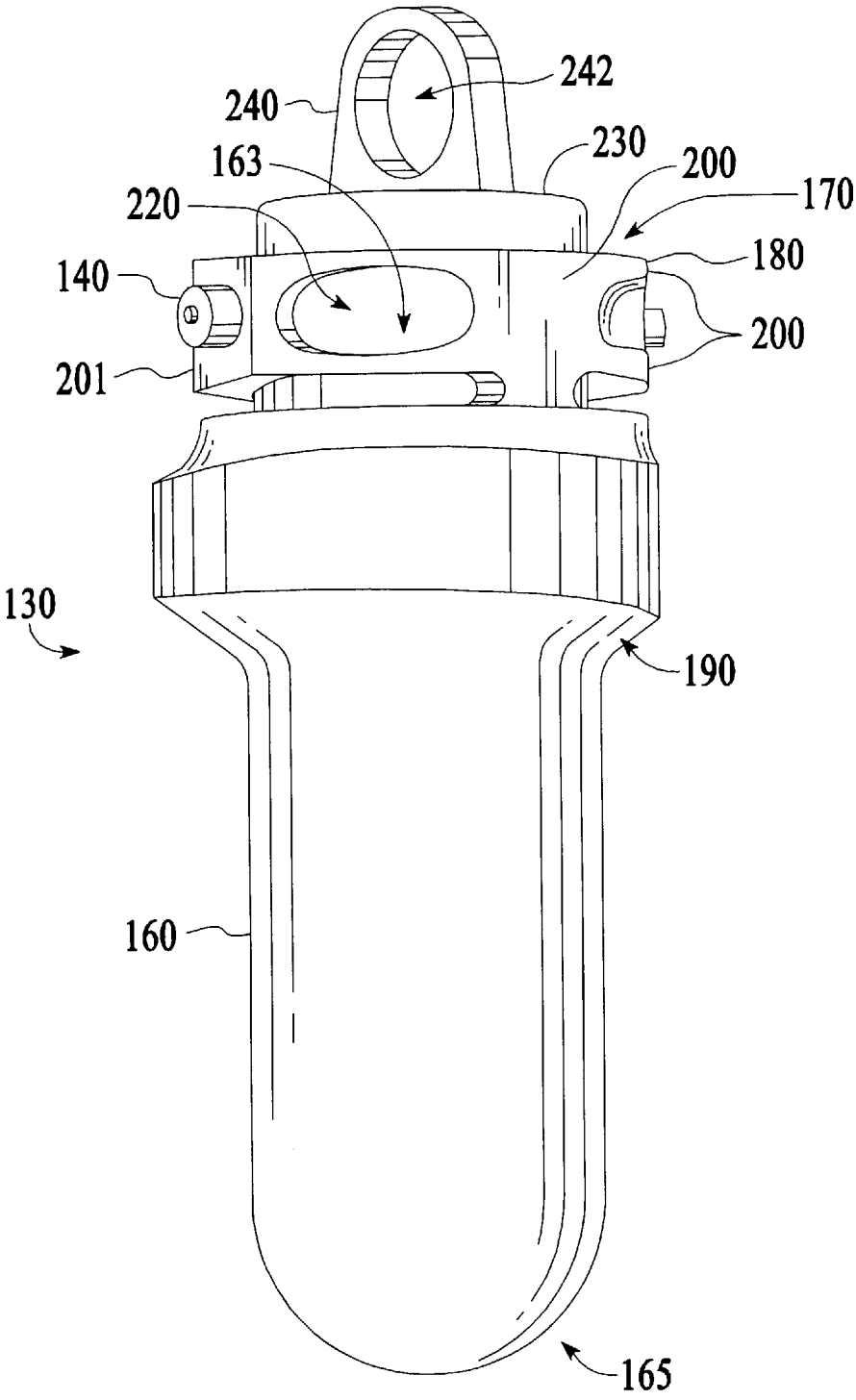
FIG. 2 is a perspective view of a bucket, cap and trunnion according to an embodiment of the present invention.
Figure 8C:
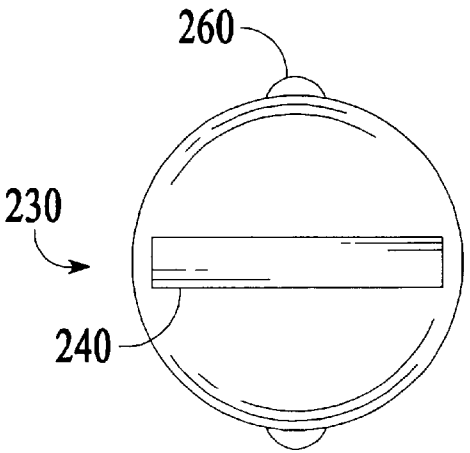
Figure 8B:
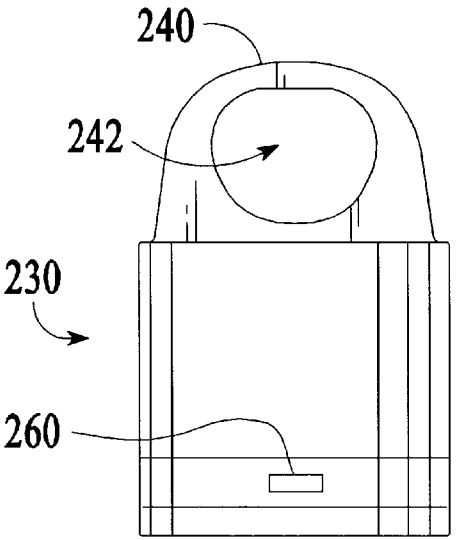
Figure 8A:
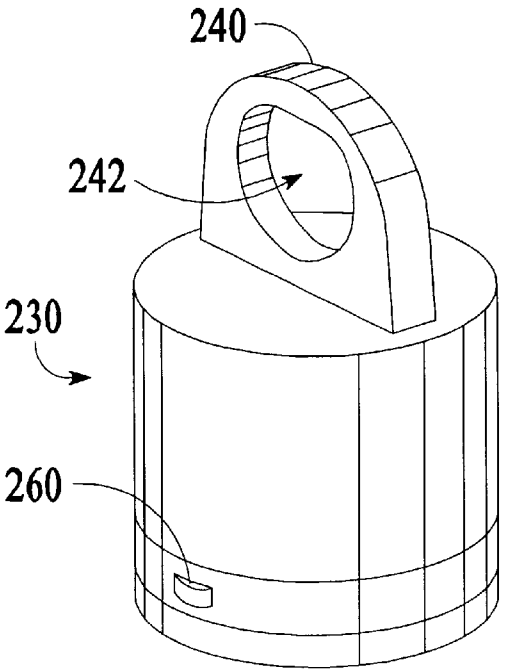

FIG. 8*a* is an angled perspective view of the cap of the bucket of FIG. 2 showing the pegs of the self-seating cap;

FIG. 8*b* is an side view of the self-seating cap of FIG. 8*a;*

FIG. 8*c* is an top view of the self-seating cap of FIG. 8*a*; and

Figure 5:
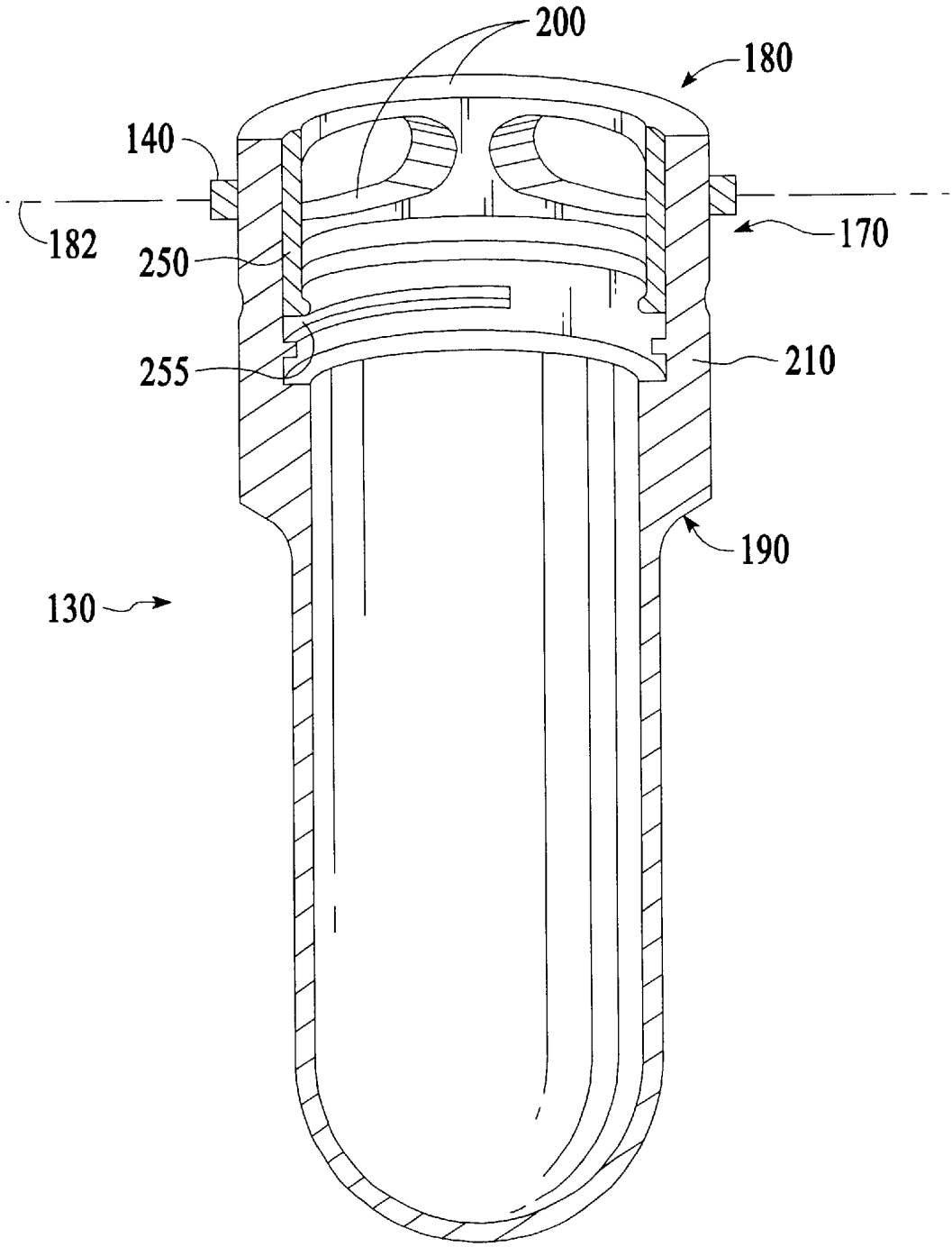
FIG. 5 is a cross-sectional side view of the bucket of FIG. 2 showing a tapering groove in an internal surface of the bucket for receiving pegs of a self-seating cap.
Figure 9:
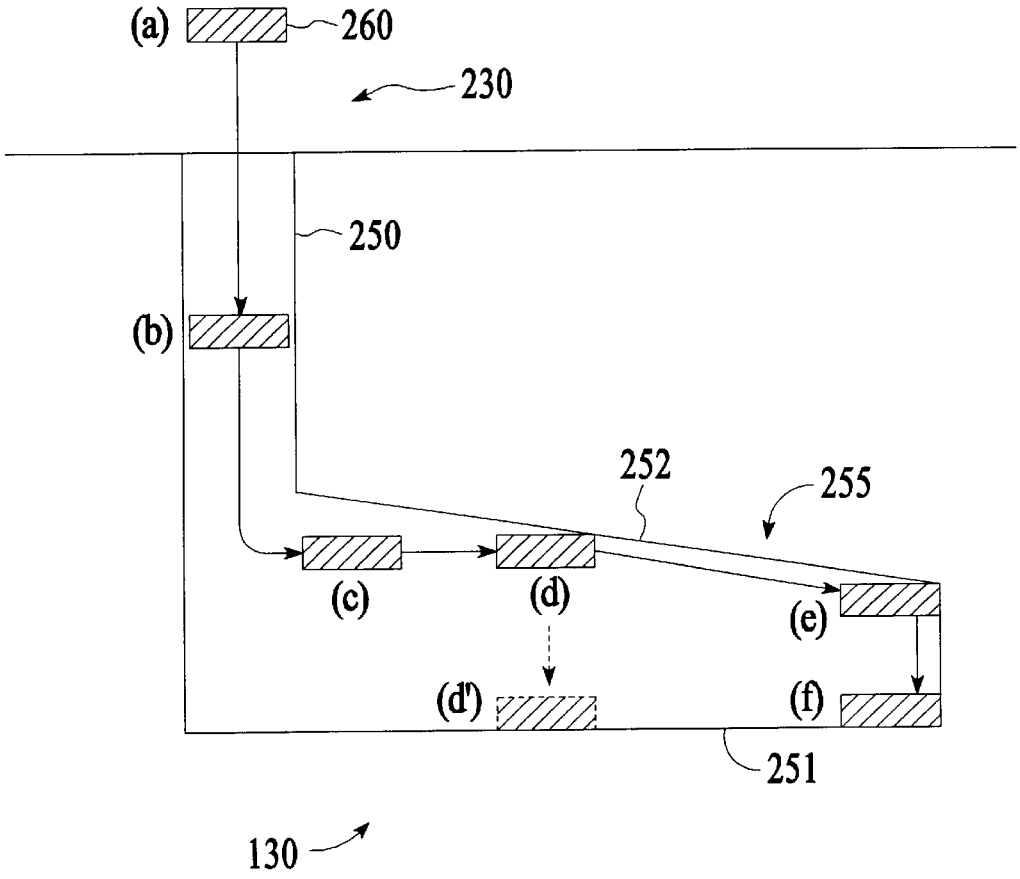

FIG. 9 is a schematic diagram of the pegs of the cap of FIG. 8*a* engaging the tapering groove in the internal surface of the bucket of FIG. 5.

DESCRIPTION

Figure 1:
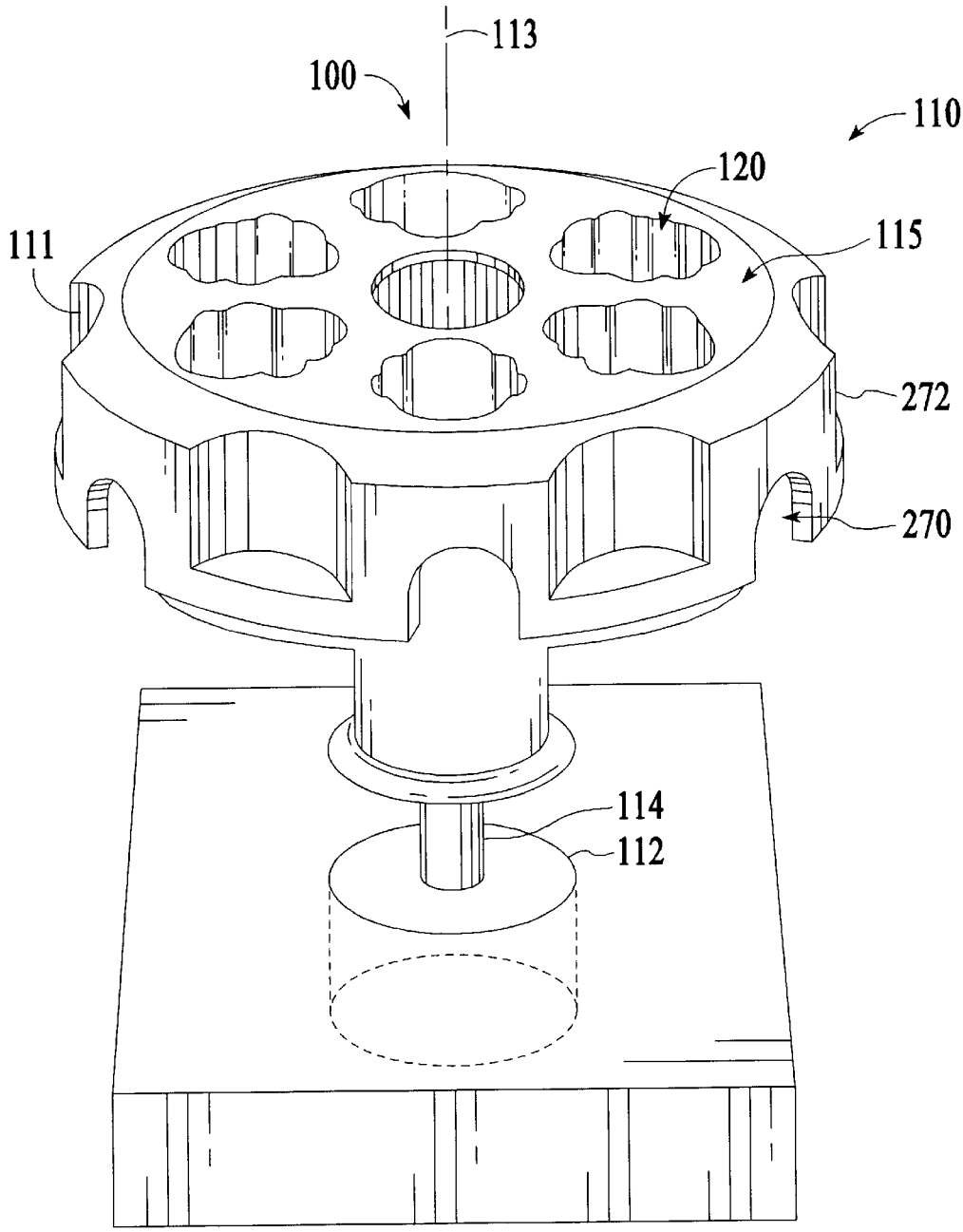
FIG. 1 is a schematic perspective view of a rotary centrifuge according to an embodiment of the present invention.

An exemplary version of a rotary centrifuge 100 according to an embodiment of the present invention as schematically illustrated in FIG. 1, is suitable for rotating a sample in a sample container to generate a centrifugal force in the sample. The sample container is exposed to the centrifugal force to separate components of the sample. For example, the rotary centrifuge 100 may separate fluid components having different densities. The illustrative version of the rotary centrifuge 100 provided herein should not be used to limit the scope of the invention, and the invention encompasses equivalent or alternative versions, as would be apparent to one of ordinary skill in the art.

Generally, the rotary centrifuge 100 comprises a rotatable hub 110 having a plurality of circumferentially spaced apart bucket carriers 115 comprising sockets 120 which receive the pivoting buckets 130, for example, the hub 110 may have at least about four bucket carriers 115 that are angularly spaced apart and distributed. In the version shown, the rotary centrifuge has six bucket carriers 115 that are located about 60° apart. The hub 110 comprises a peripheral carrier ring 272 that has seating surfaces 270 to support the buckets 130 in operation. The hub 110 may also have indentations 111 along its outer periphery to reduce the mass of the hub 110 which would otherwise would cause undesirable stresses in the regions between the sockets 120 of the hub 110 during rotation of the hub. In one embodiment, the hub 110 is made from a metal, such as titanium or aluminum.

The rotary centrifuge 100 further comprises a motor 112 to rotate the hub 110 about a rotation axis 113 to generate a centrifugal force in samples that are in the buckets 130. For example, the motor 112 may be a rotary electric motor. The motor 112 typically comprises an axle 114 that is engaged in a slot (not shown) of the hub 110 to allow the motor 112 to rotate the hub 110. In one embodiment, the motor 112 rotates the hub 110 at an angular velocity of from about 1,000 to about 40,000 rpm.

Figure 3:
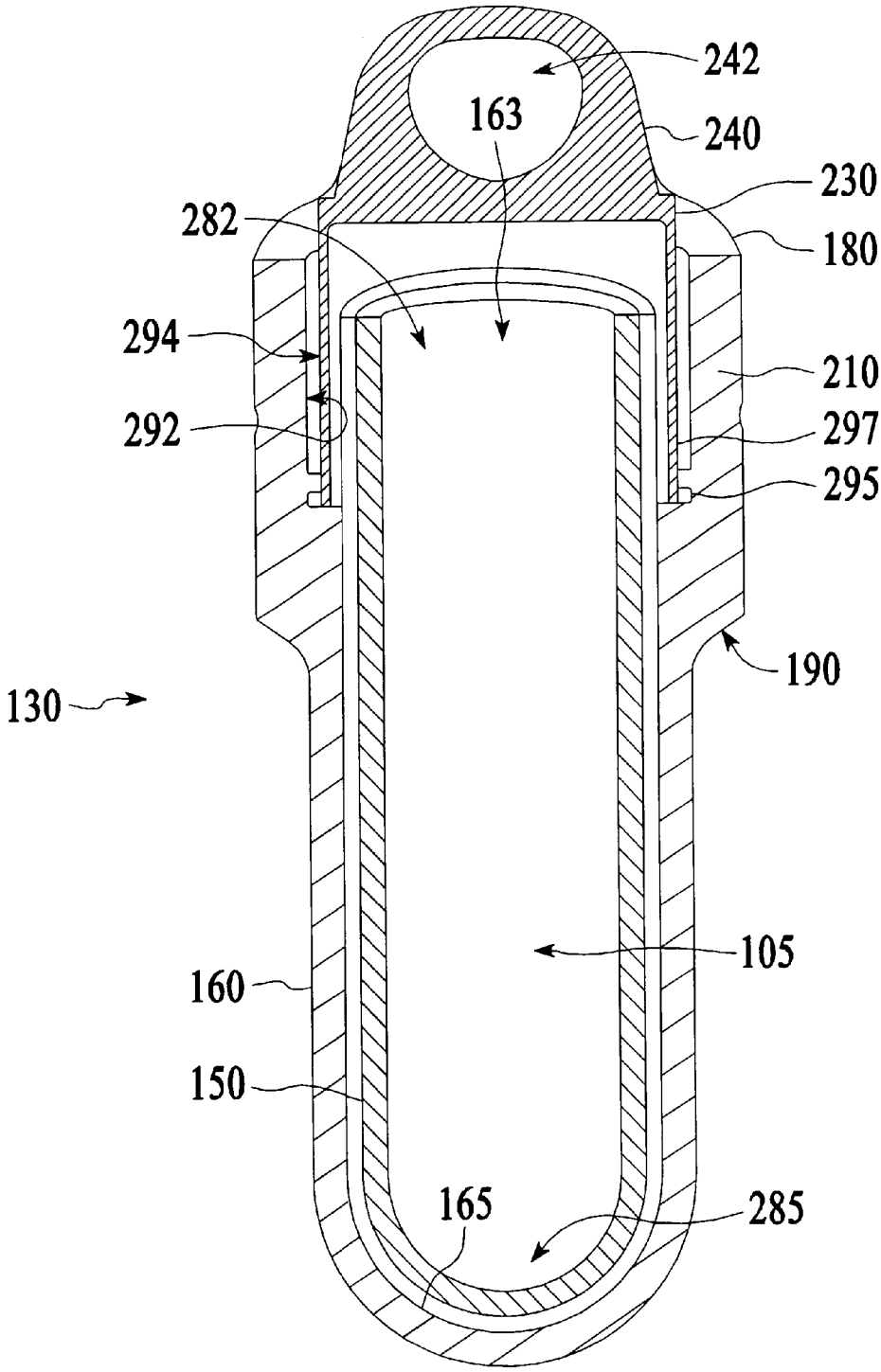
FIG. 3 is a cross-sectional side view of the bucket of FIG. 2 showing a sample container in the bucket.
Figure 4:
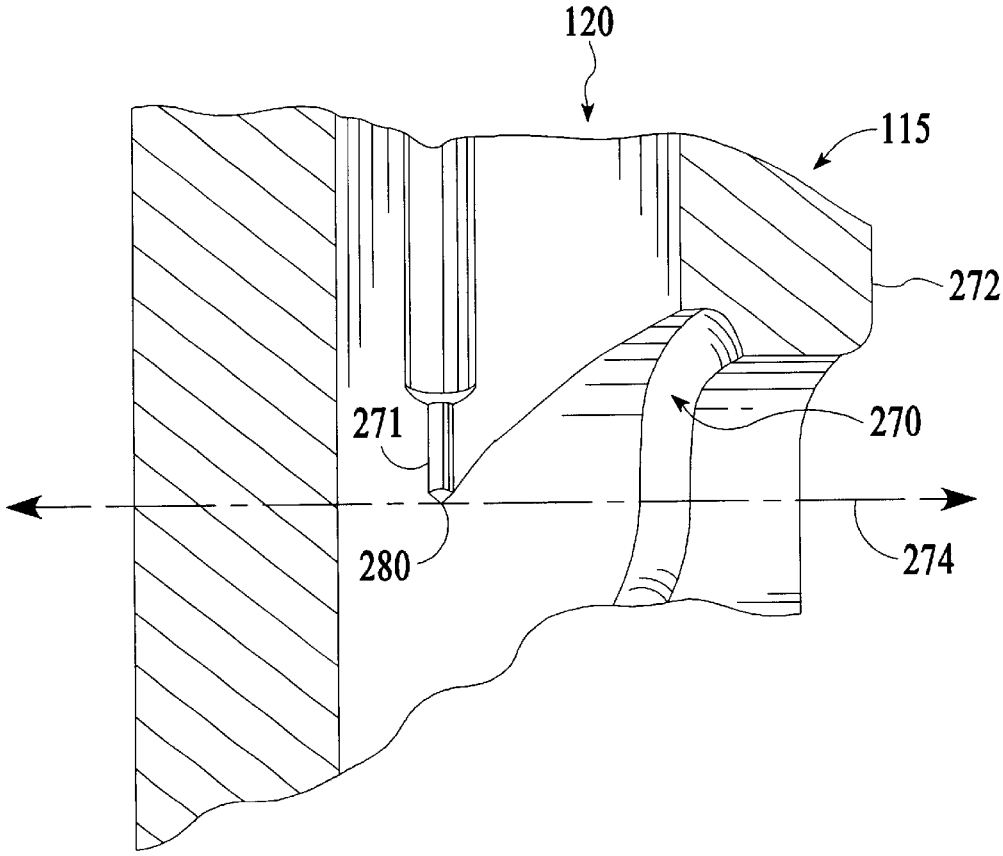
FIG. 4 is a schematic cross-sectional side view of a portion of a hub of the rotary centrifuge of FIG. 1.

The buckets 130, as shown in FIGS. 2 and 3, are supported by the bucket carriers 115 of the hub 110 that allow the buckets 130 to pivot and swing radially outwardly as the hub 110 rotates and angularly accelerates. In one version, as shown in FIG. 1, the bucket carriers 115 are integral with the hub 110 (as shown) and comprise sockets 120 having pin slots 271 that have an apex 280 as shown in FIG. 4. The pivot pins 140 of the bucket 130 are supported in the apex 280 of the pin slots 271 of the bucket carriers 115, such that the hub 110 is stationary, the buckets 130 remain vertically oriented and when the hub is rotating the buckets pivot about the pins 140 to a radially horizontal position. The apex 280 typically has a curvature that is complementary to the shape of the pin 140. In another version (not shown), the bucket carriers 115 are secured to the hub 110 (or to arms extending from the hub) by suitably matched bolts or rivets and mounting holes.

The buckets 130 are capable of holding sample containers 150 in the rotary centrifuge 100, as illustrated in FIGS. 2 and 3. Each bucket 130 comprises a receptacle 160 capable of receiving a sample container 150. For example, the receptacle 160 may be shaped to match the external shape of the sample container 150 and sized slightly larger than the sample container 150 to snugly receive the sample container 150. Each receptacle 160 has an open end 163 at its top through which a sample container 150 is inserted and a closed end 165 at its bottom to support the sample container 150.

The bucket 130 further comprises an seating surface 190, as shown in FIG. 2, that in operation, contacts an external seat 270 of rotary centrifuge 100 to stabilize the position of the bucket 130 and reduce the load applied to the bucket components. For example, the external seat 270 may be formed by a surface of the ring 272 of the hub 110, as shown in FIG. 4. In this version, the seating surface 190 comprises a convex surface of the receptacle 160 that mates with a corresponding concave external surface 270 of the ring 272 of the hub 110. As the bucket 130 swings upwardly into a horizontal plane, centrifugal forces pull the bucket 130 radially outwardly. At particular rotational velocities, the bucket 130 is pulled out sufficiently far to allow the bucket seating surface 190 to contact and rest on the external seat 270 of the ring 272. This allows the external seat 270 to relieve the load of the centrifugal forces that is being applied to the pivot pins 140. For example, the bucket 130 may seat on the ring 272 at rotational speeds of from about 2000 to about 4000 rpm. In the seated position, the centrifugal forces applied to the samples in the buckets 130 continue to be along radial axes 274 normal to the centrifuge rotation axis 113, as shown in FIG. 4.

Figure 6:
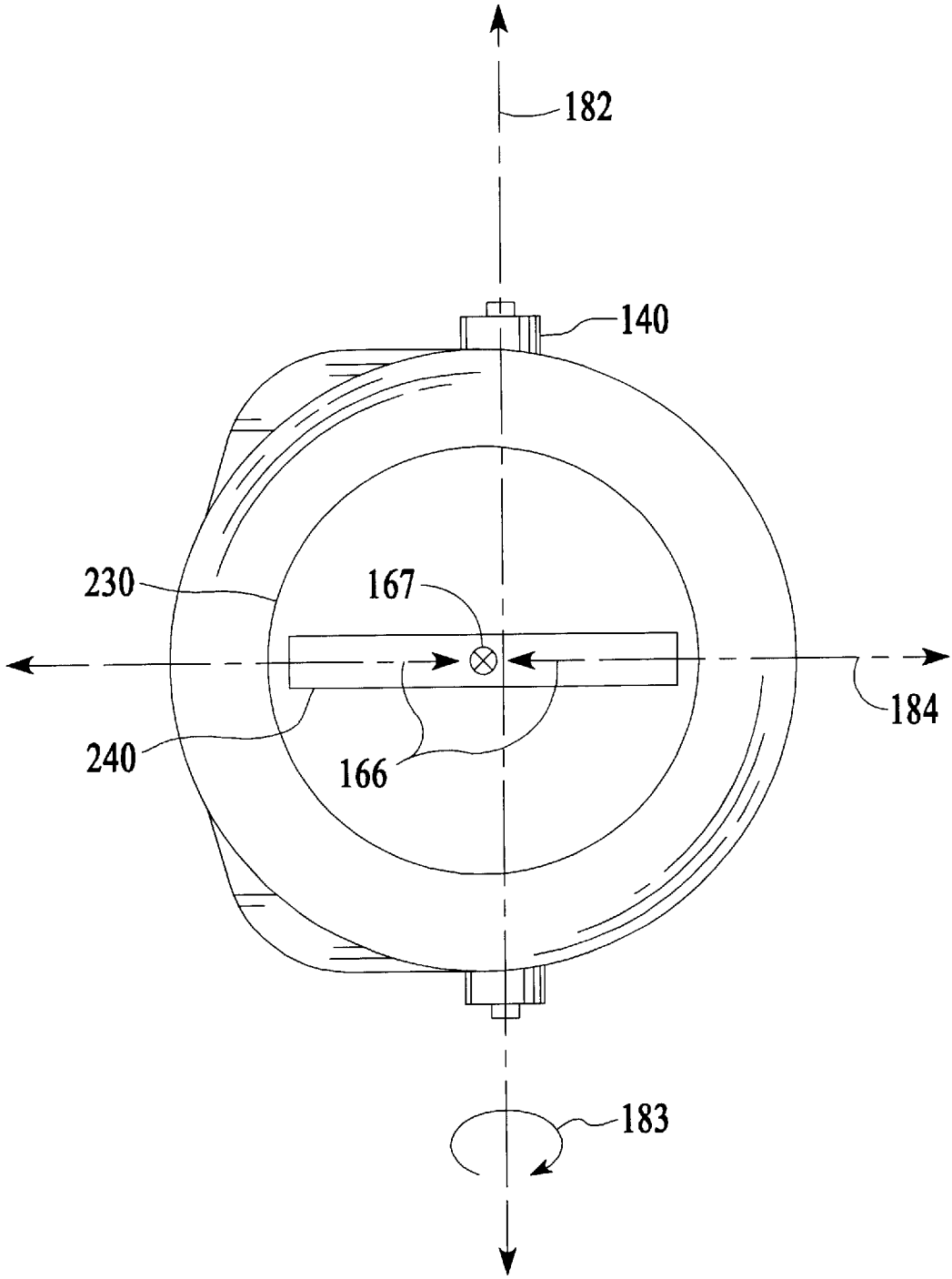
FIG. 6 is a top view of the bucket of FIG. 2.

The bucket 130 also comprises a trunnion 170 that is joined to the receptacle to allow attachment of the bucket 130 to the carrier assembly 115, as illustrated in FIGS. 5 and 6. In the version shown, the trunnion 170 extends upwardly from the open end 163 of the receptacle 160. The trunnion 170 may comprise a metal, such as for example titanium. Each trunnion 170 comprises one or more pivot pins 140 that allow the bucket 130 to pivot in engagement with the bucket carriers 115 under an applied centrifugal force. The trunnion 170 typically comprises a pair of pivot pins 140 that oppose one another and are positioned symmetrically along a pivoting axis 182 about which the bucket 130 can rotate. The pivot pins 140 may be shaped as, for example, cylindrical protrusions, concave stumps, or tapered rods. The pivoting allows the centrifugal forces to be applied along the length of the sample containers thereby increasing the effect of the centrifugal forces on the volume of the samples.

Returning to FIG. 5, the trunnion 170 also comprises a trunnion spring 180 that allows a radially outward displacement of the portion of the receptacle 160 of the bucket 130 below the pivot pins 140. In one version, the trunnion spring 180 comprises a plurality of cutouts 220 that each define a flexible span 200 that is sufficiently thin to flex under application of the centrifugal force. The cutouts 220 further define side supports 210 between adjacent of cutouts 220 that serve to support the spans 200 thereby allowing the spans to flex within the gap between the supports 210. At least one of the cutouts 220, may be, for example, substantially oval in shape. In one version, the flexible spans 200 are arcuate members having a tapering thickness that tapers to a minimum at about the center of the span 200. For example, the minimum thickness of each span may be, for example, less than about 100 mils, or even less than about 50 mils. Preferably, the spans 200 comprise two sets of opposing spans 200 with the pivot pins 140 mounted on a shoulder 201 between the spans. In operation, as the trunnion spring 180 flexes under an applied centrifugal force, the opposing spans 200 flex in a similar shape to thereby allow the pivot pins 140 to remain aligned to each other. In one version, the trunnion spring 180 is capable of flexing a sufficient distance to allow the receptacle 160 to be displaced by at least about 20 mils relative to the pivot pins 140, and may additionally be sufficiently inflexible to limit displacement of the receptacle 160 to less than about 50 mils relative to the pivot pins 140. As shown in FIG. 6, the trunnion spring 180 may be attached to the receptacle 160 along a second axis 184 that is substantially orthogonal to the pivoting axis 182 of the pivot pins 140. This structure and attachment allow the trunnion spring 180 to suitably flex as force is applied between the receptacle 160 and the pivot pins 140.

In one version, the trunnion 160 and receptacle 160 form an integral unitary member, as shown in FIG. 5. This integral bucket 130 is substantially absent a material interface between the receptacle 160 and the integral trunnion 170. For example, the receptacle 160 and the trunnion 170 may be machined from a unitary piece of a material, such as single bar stock of metal, such as titanium. This integral bucket 130 is typically stronger and more durable than a bucket that is formed from assembling separate parts. Furthermore, the integral bucket 130 may be more easily manufactured than an assembled bucket. However, the trunnion 160 and receptacle 170 may also be separate pieces (not shown) that are joined together, for example, by conventional joining systems, such as for example, a screw joint, welding or bolts.

During operation of a conventional rotary centrifuges, the centrifugal force generates a side-loading force on the pivot pins 140 at high rotational speeds when the seating surface 190 of the bucket 130 is seated on the external surface 270 of the hub 110. The side-loading force is generated parallel to the axis of rotation 113 of the hub 110 and can degrade the structural integrity of the pivot pins 140 or even break the pins 140. The side-loading force can also damage the trunnion spring 180 by the application of a sideways shearing force on the spring 180. For example, if the bucket 130 seats in a position that is not fully horizontal, or if the bucket 130 is not fully seated, the pivot pins 140 and trunnion spring 180 are subjected to the side-loading force.

In one version of the present invention, the pivot pins 140 and seating surface 190 are adapted to allow the bucket 130 to seat on the ring 272 substantially without generating a side-loading force on the pivot pins 140. In this version, the receptacle 160 comprises a longitudinal axis 167 passing centrally therethrough, and the pivoting axis 182 of the pivot pins 140 are horizontally offset by a predefined distance from the longitudinal axis 167, as shown in FIG. 6. In one embodiment, the pivot pins 140 are offset from the longitudinal axis 167 by from about 10 to about 30 mils, such as by about 20 mils.

In the initial stationary position of the rotary centrifuge 100, as shown in FIG. 7*a*, the pivot pins 140 rest at the apex 280 of pin slots 271 (see FIG. 4) and gravity causes the buckets 130 to remain in a substantially vertical orientation. When the hub 110 rotates, the bucket 130 swings upwardly, as shown in FIG. 7*b*, and the seating surface 190 of the bucket 130 approaches and eventually contacts the external seat 270 of the ring 272 at the contact point 281. For example, the longitudinal axis 167 of the bucket 130 may form an angle with the radial axis 274 of from about 0.5 to about 3 degrees. At the same time, the centrifugal force that acts on the bucket 130 as a result of the rotation of the hub 110 flexes the trunnion spring 180 and allows the bucket 130 to be displaced radially outwardly.

As the rotational velocity of the hub 110 increases, the centrifugal force on the bucket 130 increases causing the bucket 130 to further pivot about the contact point 281, as shown progressively in FIGS. 7*c* and 7*d*, to become fully seated on the seat 270 of the ring 272. The pivot pins 140 become displace upwardly along the pin slots 271 from their resting surfaces 280 by a vertical distance 141. As the hub 110 is further rotated to higher angular acceleration, the bucket 130 pivots on the resting surfaces 280 as its seat 270 moves outwardly and upwardly toward the inner seat 270 of the ring 272. For example, the pivot pins 140 may displace upwardly by a distance of from about 10 to about 35 mils in the pin slots 271. As this movement continues, the bucket 130 becomes approximately horizontal, until its seating surface 190 eventually comes to rest completely against the seating surface of the ring 272, as shown in FIG. 7*d*.

With increased rotational velocities, the centrifugal force temporarily deforms the seat 270 of the ring 272, including retracting a lower portion of the seat 270, as shown in FIG. 7*e*. For example, the seat 270 of the ring 272 may be deformed such that a portion of the seat is horizontally displaced by a distance 142. As a result, the pivot pins 140 and the bucket 130 are displaced downward along the pin slots 271, as shown in FIG. 7*f*. For example, the pivot pins 140 may be displaced downwardly by from about 10 to about 35 mils. In one embodiment, the pivot pins 140 are returned to their seated positions on the resting surfaces 280 of the pin slots 271. Thus, the side-loading force that would otherwise damage or destroy the pivot pins 140 is at least reduced, and may even be eliminated. By decreasing the side-loading force, the offset pivot pins 140 increase the durability of the bucket 130. The firm seating of the bucket 130 on the ring 272 allows the ring 272 rather than the pivot pins 140 to support the centrifugal force on the bucket 130.

The bucket 130 also comprises a cap 230 to close the open end 163 of the receptacle 160, as illustrated in FIGS. 8*a* to 8*c*. The cap 230 may comprise a first o-ring 295 to seal the cap 230 against the bucket 130. The o-ring 295 may comprise, for example, a fluoroelastomer. The cap 230 has a handle 240 adapted to be grasped to remove the cap 230 from the bucket 130. For example, the handle 240 may comprise a loop-shaped protrusion with a finger hole 242 to facilitate a tight grip. The handle 240 may also be adapted to be grasped by a robot arm. The geometry of the finger hole 242 is adapted to withstand the centrifugal force without deforming or breaking, while having a low overall mass to minimize the weight of the bucket 130 on the carrier assembly 115. The cap 230 may be made from aluminum.

In another version, the open end 163 of the receptacle 160 has an internal surface that comprises a groove 250, 255 therein, and the bucket cap 230 comprises a peg 260 that fits in the groove 250, 255, to allow the cap 230 to self-seat and close the bucket 130, as illustrated in FIG. 9. The groove 250, 255 is sized to receive the peg 260, and has a first portion 250 that is substantially vertical. The groove 250 also has a second portion 255 having a tapering width that decreases from a first larger width to a second smaller width. In one embodiment, the first portion 250 is in the trunnion 170 and the second portion 255 is in the receptacle 160. Typically, the second portion of the groove 255 comprises a first internal wall that is substantially parallel to a plane that is normal to the longitudinal axis 167, and a second internal wall that is at an angle relative to the normal plane. For example, the second wall 252 may slope down toward the first wall 251. In one embodiment, the groove 255 is shaped as a right-triangle.

To close the bucket 130, an operator aligns the cap 230 with the receptacle 160 and pushes the cap 230 into the receptacle 160 such that the peg 260 slides down the first portion of the groove 250, as in positions (a) and (b), until the cap 230 contacts the first o-ring 295. Then, the operator rotates the cap 230 with respect to the receptacle 160 to slide the peg 260 along the top of the second portion of the groove 255, as in positions (c), (d), and (e), sliding the cap 230 beside the o-ring 295. For example, the operator may rotate the cap 230 clockwise, looking down onto the bucket 130 from the side of the cap 230, by turning the handle 240. In one embodiment, the pegs 260 and groove 255 are adapted to allow a rotation of the cap 230 in the bucket 130 of from about ⅙ to about ½ of a whole revolution, such as from about ¼ to about ½ of a turn. This turning angle may be preferable because it can be easily executed by a human operator with one twist of the hand that minimizes disturbance of the sample 105. When the bucket 130 is being centrifuged, the peg 260 slides in the second portion of the groove 255, such as into position (f). The groove 255 is shaped such that under the application of the centrifugal force the cap 230 slides toward the first internal wall 251 of the groove 255 until the cap 230 closes the bucket 130.

The groove 250, 255 maintains a suitable seal between the cap 230 and the receptacle 160. If the cap 230 is not entirely securely attached to the receptacle 160, the centrifugal force produced by the motor 112 causes the cap 230 to self-seat into the receptacle 160. For example, if the cap 230 is only partially placed into the bucket 130 such that the cap peg 260 is at position (e), the radially outward centrifugal force that is generated when the bucket 130 is being rotated and is in a substantially horizontal orientation, causes the cap 230 to slide radially outwardly such that the cap peg 260 becomes securely locked by the centrifugal force at position (f). In another example, if the cap peg 260 is at position (d), the centrifugal force causes the cap 230 to slide out such that the cap peg 260 is at position (d'). The groove 255 may additionally be advantageous because, if the cap 230 is initially not fully screwed in the receptacle 160, the width of the groove 255 allows a surface of the cap 230 to support the cap 230 on the receptacle 160 rather than having the pegs 260 support the weight of the cap 230.

Sample containers 150 are provided for placement in the buckets 130 of the rotary centrifuge 100, as shown in FIG. 3. The sample container 150 comprises a tube having open and closed ends 282, 285, respectively, the open end 282 having an outer surface 294. For example, the sample container 150 may be an elastomer test tube, such as comprising a polyallomer or polycarbonate. In one version, the bucket cap 230 (as shown) or a second cap (not shown) is adapted to close the sample container 150. After centrifugal operation, the motor 112 decreases the angular velocity of the hub 110 to decrease the magnitude of the centrifugal force and smoothly return the buckets 130 to their original upright positions. When the hub 110 has come to a stop, the caps 230 may be removed from the buckets 130 to by pulling their handles 240 to access the sample containers 150.

Although the present invention has been described in considerable detail with regard to certain preferred versions thereof, other versions are possible. For example, the present invention could be used with other rotary centrifuges, such as a rotary centrifuge that allows the sample to be placed directly into the bucket. Thus, the appended claims should not be limited to the description of the preferred versions contained herein.

What is claimed is:

1. A bucket capable of holding a sample container in a rotary centrifuge, the bucket comprising:

(a) a receptacle to receive the sample container; and (b) a trunnion joined to the receptacle, the trunnion comprising:

(i) a plurality of cutouts that each define a flexible span; and (ii) pivot pins to allow the bucket to pivot under the application of a centrifugal force generated by the rotary centrifuge.

2. A bucket according to claim 1 wherein the flexible spans are arcuate members having a thickness that tapers from a first larger size to a second smaller size.

3. A bucket according to claim 1 wherein at least one of the cutouts has a substantially oval shape.

4. A bucket according to claim 1 wherein the flexible spans are sufficiently thin to flex under the application of a centrifugal force generated by the rotary centrifuge.

5. A bucket according to claim 4 wherein the rotary centrifuge comprises an external seat and receptacle comprises a seating surface, and wherein the flexible spans are sufficiently flexible to flex under the application of the centrifugal force to allow the seating surface of the receptacle to seat against the external seat of the rotary centrifuge whereby the centrifugal force applied on the pivot pins may be reduced.

6. A bucket according to claim 1 wherein the pivot pins comprise a pivoting axis, and wherein the flexible spans are capable of flexing a sufficient distance to allow the receptacle to be displaced relative to the pivoting axis of the pivot pins by at least about 20 mils.

7. A bucket according to claim 6 wherein the flexible spans are sufficiently inflexible to limit the displacement of the receptacle relative to the pivoting axis of the pivot pins to less than about 50 mils.

8. A bucket according to claim 1 wherein the receptacle and trunnion form an integral unitary member.

9. A bucket according to claim 8 wherein the integral unitary member comprises titanium.

10. A bucket according to claim 1 further comprising a cap having pegs extending therefrom, and wherein the receptacle comprises an open end having an internal surface with a groove that is sized to receive the pegs of the cap, the groove having a width that gradually reduces in size from an opening to an end of the groove.

11. A bucket according to claim 1 wherein the receptacle comprises a longitudinal axis, and wherein the pivot pins have a pivoting axis that is offset from the longitudinal axis by at least about 10 mils.

12. A rotary centrifuge comprising a plurality of buckets according to claim 1, the rotary centrifuge further comprising:

(1) a rotatable hub having sockets capable of receiving the buckets; and (2) a motor to rotate the hub to generate the centrifugal force.

13. A bucket capable of holding a sample container in a rotary centrifuge, the rotary centrifuge comprising an external seat, and the bucket comprising:

(a) a receptacle to receive the sample container, the receptacle comprising a seating surface; and (b) a trunnion joined to the receptacle, the trunnion comprising:

(i) a plurality of cutouts that each define a flexible span that is sufficiently flexible to flex under application of a centrifugal force generated by the rotary centrifuge to allow the seating surface of the receptacle to seat against the external seat of the rotary centrifuge whereby the centrifugal force applied on the pivot pins may be reduced; and (ii) pivot pins to allow the bucket to pivot under the application of the centrifugal force.

14. A bucket according to claim 13 wherein the flexible spans are arcuate members having a thickness that tapers from a first larger size to a second smaller size.

15. A bucket according to claim 13 wherein at least one of the cutouts has a substantially oval shape.

16. A bucket according to claim 13 wherein the pivot pins have a pivoting axis, and wherein the flexible spans are capable of flexing a sufficient distance to allow the receptacle to be displaced relative to the pivoting axis of the pivot pins by at least about 20 mils.

17. A bucket according to claim 16 wherein the flexible spans are sufficiently inflexible to limit the displacement of the receptacle relative to the pivoting axis of the pivot pins to less than about 50 mils.

18. A bucket according to claim 13 wherein the receptacle and trunnion form an integral unitary member.

19. A bucket according to claim 18 wherein the integral unitary member comprises titanium.

20. A bucket according to claim 13 further comprising a cap having pegs extending therefrom, and wherein the receptacle comprises an open end having an internal surface with a groove that is sized to receive the pegs of the cap, the groove having a width that gradually tapers in size from the opening to the end of the groove.

21. A bucket according to claim 13 wherein the receptacle comprises a longitudinal axis, and wherein the pivot pins have a pivoting axis that is offset from the longitudinal axis by at least about 10 mils.

22. A rotary centrifuge comprising a plurality of buckets according to claim 13, the rotary centrifuge further comprising:

(1) a rotatable hub having sockets capable of receiving the buckets; and (2) a motor to rotate the hub to generate the centrifugal force.

23. A bucket capable of holding a sample container in a rotary centrifuge, the bucket comprising:

(a) a receptacle to receive the sample container, the receptacle comprising an open end having an internal surface with a groove, the groove having an opening, an end, and a width that decreases in size from the opening to the end;

(b) a cap capable of closing the open end of the receptacle, the cap comprising pegs that are sized to fit in the groove; and (c) a trunnion comprising a pair of pivot pins to allow the bucket to pivot under the application of a centrifugal force generated by the rotary centrifuge.

24. A bucket according to claim 23 wherein the groove comprises an internal wall that is perpendicular to a direction of the centrifugal force such that under the application of the centrifugal force the pegs of the cap are forced toward the internal wall by the centrifugal force to cause the cap to be locked in place in the receptacle.

25. A bucket according to claim 23 wherein the width of the groove is shaped as a right-triangle.

26. A bucket according to claim 25 wherein the right-triangle has a first internal wall that is substantially parallel to a plane that is normal to a longitudinal axis of the receptacle and a second internal wall that slopes down toward the first wall.

27. A bucket according to claim 23 wherein the trunnion further comprises a plurality of cutouts that each define a flexible span.

28. A bucket according to claim 23 wherein the receptacle comprises a longitudinal axis, and wherein the pivot pins have a pivoting axis that is offset from the longitudinal axis.

29. A bucket according to claim 23 wherein the receptacle and trunnion form an integral unitary member.

30. A rotary centrifuge comprising a plurality of buckets according to claim 23, the rotary centrifuge further comprising:

(1) a rotatable hub having sockets capable of receiving the buckets; and (2) a motor to rotate the hub to generate the centrifugal force.

31. A bucket capable of holding a sample container in a rotary centrifuge, the bucket comprising:

(a) a receptacle to receive the sample container, the receptacle comprising an open end having an internal surface with a groove therein, the groove having an opening, an end, and a width that decreases from the opening to the end;

(b) a cap capable of closing the open end of the receptacle, the cap comprising pegs that are sized to fit in the groove; and (c) a trunnion comprising:

(i) a plurality of cutouts that each define a flexible span that is sufficiently thin to flex under application of a centrifugal force generated by the rotary centrifuge; and (ii) a pair of pivot pins to allow the bucket to pivot under the application of the centrifugal force.

32. A bucket according to claim 31 wherein the width of the groove is shaped as a right-triangle that has a first internal wall that is substantially parallel to a plane that is normal to a longitudinal axis of the receptacle and a second internal wall that slopes down toward the first wall, whereby under application of the centrifugal force the cap is self seating and slides toward the first internal wall until it closes the bucket.

33. A bucket according to claim 31 wherein the receptacle comprises a longitudinal axis, and wherein the pivot pins have a pivoting axis that is offset from the longitudinal axis.

* * * * *